United States Patent [19]

Johstoneaux

[11] Patent Number: 5,010,867

[45] Date of Patent: Apr. 30, 1991

[54] FUEL ECONOMIZER

[75] Inventor: Raphael B. Johstoneaux, Miami, Fla.

[73] Assignee: S.O.F.O. Engineering & Distributing Co., Hialeah, Fla.

[21] Appl. No.: 943,722

[22] Filed: Dec. 19, 1986

Related U.S. Application Data

[63] Continuation of Ser. No. 156,852, Jun. 5, 1980, abandoned, which is a continuation of Ser. No. 817,172, Jul. 20, 1977, abandoned, which is a continuation-in-part of Ser. No. 657,572, Feb. 12, 1976, abandoned.

[51] Int. Cl.[5] ..... F02M 37/00

[52] U.S. Cl. ..... 123/511; 123/514

[58] Field of Search ..... 123/510–517

[56] References Cited

U.S. PATENT DOCUMENTS

| | | | |
|---|---|---|---|
| 984,032 | 2/1911 | Seager | 261/73 |
| 1,180,826 | 4/1916 | Carson | 123/514 |
| 1,269,787 | 6/1918 | Church | 123/516 |
| 1,323,415 | 12/1919 | Sherbondy | 137/565 |
| 1,367,454 | 2/1921 | Braselton | 417/40 |
| 1,376,201 | 4/1921 | Harris | 123/460 |
| 1,492,147 | 4/1924 | Van Hise et al. | 123/510 |
| 1,780,336 | 11/1930 | Canton | 417/394 |
| 1,849,590 | 3/1932 | Phillips | 137/565 |
| 2,297,129 | 9/1942 | Bohnstedt | 123/511 |
| 2,323,525 | 7/1943 | Ebel et al. | 123/516 X |

FOREIGN PATENT DOCUMENTS

| | | | |
|---|---|---|---|
| 608211 | 12/1934 | Fed. Rep. of Germany | 123/511 |
| 720745 | 2/1932 | France | 123/511 |
| 2303167 | 10/1976 | France | 123/510 |

*Primary Examiner*—Tony M. Argenbright

*Attorney, Agent, or Firm*—Cushman, Darby & Cushman

[57] ABSTRACT

A device for inclusion in the line from a fuel reservoir which includes a fuel pump and a carburetor, a device arranged intermediate the carburetor and the fuel pump which includes a main container having an inlet port from an upstream inlet port above the floor level and a downstream outlet port at about the floor level and said device being arranged physically near the level of the entrance to the carburetor of the vehicle on which it is installed; the container is a pressure reduction unit and is under partial pressure from the fuel pump, operating under a somewhat reduced fuel pressure relative to that of the delivered fuel pump pressure; the pressure reduction is accomplished as follows, a return line controls the upper zone of the container to the fuel reservoir and this line includes a valve to adjust the normal pressure in the container to that which delivers the best pressure controlling the flow of fuel to the carburetor.

1 Claim, 1 Drawing Sheet

FUEL ECONOMIZER

CROSS REFERENCE TO RELATED APPLICATIONS

This application is a continuation of Ser. No. 156,852, filed June 5, 1980, which is a continuation of Ser. No. 817,172, filed July 20, 1977, which is a C-I-P of Ser. No. 657,572, filed Feb. 12, 1976, all now abandoned.

FIELD OF THE INVENTION

This invention relates to a fuel economizer and more particularly to a device to be inserted between the fuel pump and a carburetor so that the fuel pumped by a fuel pump on a vehicle will be fed from the container to the carburetor at a reduced pressure, which is adjustable.

BACKGROUND OF THE INVENTION

It has been found that the use of a carburetor to which fuel is supplied under pressure causes a loss of efficiency in that the fuel is not metered correctly with a consequent reduction in gas mileage per unit volume of fuel used.

It has further been found that if the fuel is pumped to a location physically at about the carburetor but delivered to the carburetor at a reduced, predetermined pressure for the particular engine on which it is installed so that in response to the demands of the operator of the vehicle on which it is installed an increased efficiency results.

Accordingly, it is an object of this invention to provide an improved system for metering fuel to a carburetor which includes a container arranged in the fuel line physically near the level of the inlet of the carburetor and which includes an outlet from the lower zone of the container into which a supply of fuel is flowed by the fuel pump into the container from a point of entrance about the level of the exit and above the floor level and which preferably includes an overflow line of a predetermined diameter for return of fuel to the main vehicle fuel reservoir with a control valve in the container or overflow line to adjust the pressure in the container and, hence, the delivery pressure of the fuel.

It is a general object of this invention to provide an improved fuel economizer for vehicles, either land or water vehicles which is simple to install, inexpensive to manufacture is adapted to increase the efficiency and mileage of engines on which the same is installed.

In accordance with these and other objects which will become apparent hereinafter the instant invention will now be described with reference to the accompanying drawings, in which:

DESCRIPTION OF THE PREFERRED EMBODIMENT

Figure 1:
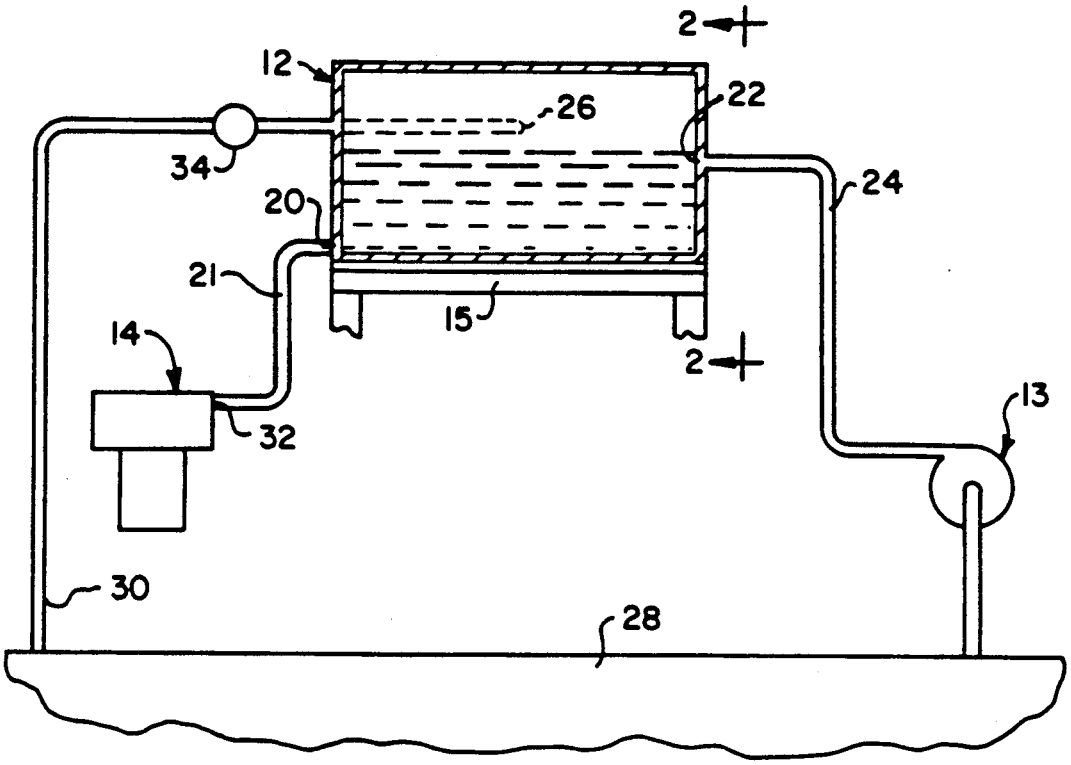
FIG. 1 is a schematic view of the fuel economizer and associated vehicle fuel feed system.
Figure 2:
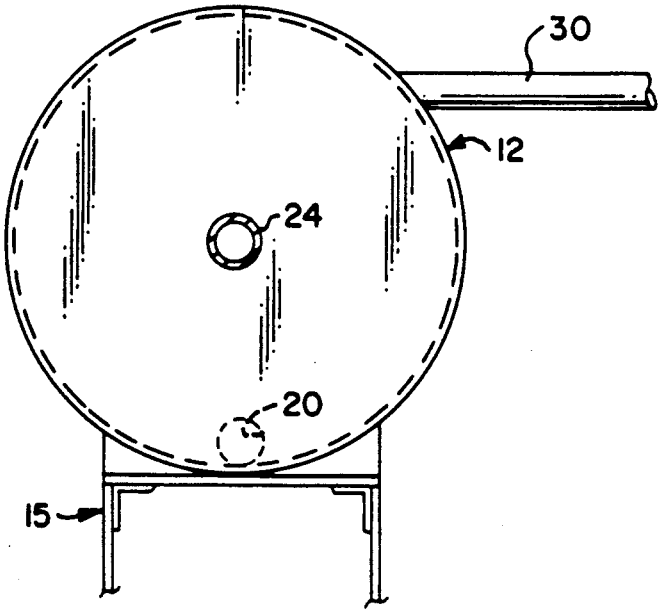
FIG. 2 is a vertical cross sectional view taken along line 2—2 of FIG. 1.

Referring to the drawings wherein reference characters designate like or corresponding parts throughout the several views, the numeral 12 generally designates a container or receiver for fuel which is connected between a fuel pump 13 and a carburetor 14 in a manner now to be described. The container is arranged on a support 15 at a level which is near the level of the entrance port to the carburetor and the exit port 20 is connected to the carburetor through a pipe or fitting 21 which leads from the container at a point adjacent the floor thereof.

Above the floor level and approximately midway between the floor and the roof of the container 12 an inlet port 22 is provided through which a pipe 24 connects from the fuel pump 13. Adjacent the roof and well above the floor level and above the inlet from the fuel pump 13 there is an overflow opening 26 which is connected to the main gas reservoir 28 of the vehicle by a suitable conduit 30 and preferably a valve 34 is provided in this line.

In use, gas is pumped in the conventional manner by the fuel pump 13 toward the carburetor 14 but, prior to reaching the carburetor it flows into the container 12 where the fuel pump pressure is reduced in the container and the gas flows through the exit port 20 to the carburetor intake 32 through the exit port 20 under the influence of the reduced pressure in the container, which may be adjusted by operation of the valve 34.

In the event that the fuel level rises beyond a desired level, there will be an overflow through the outlet 26 leading back through the pipe 30 to the main vehicle gas tank 28 where it will again blend with the gasoline therein.

In summary, the fuel is pumped into the container 12 where it then is fed to the carburetor 14 under a preselected most effective pressure to achieve the best efficiency for the particular vehicle on which it is installed. The container 12 may be built out of steel, copper, plastic or other suitable rigid material. In the ordinary operation, there will be a head of fuel in the container or a height of fuel or certain volume of fuel which will be available for feed to the carburetor 14 upon demand. Additionally, in the overflow pipe 30 leading or returning to the main vehicle tank 28, the valve 34 permits adjustment of the amount of pressure build up in the container. The container is mounted near, that is at about, or somewhat above or below, the level of the inlet of the carburetor.

What is claimed is:

1. A system for supplying liquid fuel under reduced pressure to the carburetor of an internal combustion engine said system including fuel reservoir and a fuel pump for drawing fuel from the reservoir and supplying it to the carburetor, and means for reducing the pressure at which fuel is supplied to the carburetor, said pressure reducing means comprising:

a closed container having a hollow, unencumbered interior, said container being connected between the fuel pump and the carburetor for holding a quantity of fuel sufficient for acceleration demands of the carburetor;

a first unrestricted line connected between said closed container at a location above the bottom thereof and the outlet of said fuel pump for carrying fuel to said closed container from said fuel pump;

a second unrestricted line connected between said closed container and said carburetor for supplying the latter with fuel from said closed container; and a third constantly-open relief line connected between the fuel reservoir and said closed container at a point on said closed container above the level where said first line connects thereto and adjacent the top thereof so that a predetermined quantity of fuel will be held in the said closed container and available to meet acceleration demands in response to the suction of the carburetor, said constantly-open relief line consisting of a hollow elongated conduit containing means for adjusting the openness thereof for bleeding off fuel pump pressure thereby setting a reduced pressure on the fuel in said closed container relative to fuel pump pressure thereby developing a reduced pressure at which fuel is supplied to the carburetor whereby the said closed container will hold a volume of fuel with a sufficient air or vapor cushion thereabove at a substantially uniform pressure less than fuel pump pressure while the pump is in operation.

* * * * *